United States Patent [19]

Krawagna

[11] Patent Number: 4,601,413

[45] Date of Patent: Jul. 22, 1986

[54] SNAP-ACTING SPRING DEVICE

[75] Inventor: Alois Krawagna, Toronto, Canada

[73] Assignee: Creanova AG, Zurich, Switzerland

[21] Appl. No.: 446,484

[22] Filed: Dec. 2, 1982

[30] Foreign Application Priority Data

Dec. 3, 1981 [DE] Fed. Rep. of Germany ..... 3147903

[51] Int. Cl.[4] ..... F16K 31/56

[52] U.S. Cl. ..... 222/498; 222/499; 222/515; 222/516; 222/559; 74/100 K; 267/159; 267/160

[58] Field of Search ..... 222/498, 511, 513, 559, 222/515, 516; 267/159, 160; 251/75; 200/76; 74/100 R

[56] References Cited

U.S. PATENT DOCUMENTS

| | | | |
|---|---|---|---|
| 2,139,085 | 12/1938 | Lawson | 222/559 X |
| 2,643,394 | 6/1953 | Wood | 222/498 X |
| 2,829,380 | 4/1958 | Wood | 222/498 X |
| 3,093,273 | 6/1963 | Borah | 222/498 X |
| 3,264,884 | 8/1966 | Brooker | 200/76 |
| 4,386,720 | 6/1983 | Speedie | 251/75 X |
| 4,408,703 | 10/1983 | Libit | 222/336 X |

FOREIGN PATENT DOCUMENTS

| | | | |
|---|---|---|---|
| 70495 | 1/1942 | Czechoslovakia | 222/498 |

*Primary Examiner*—Joseph J. Rolla
*Assistant Examiner*—Frederick R. Handren
*Attorney, Agent, or Firm*—Christie, Parker & Hale

[57] ABSTRACT

A hinge apparatus is disclosed, in which at least two flexible strips (1–3) are articulated, each via two articulation grooves (7, 8), to two parts (5, 6) that are movable relative to one another and are substantially cylindrical in embodiment, in such a manner that upon a relative movement of the two parts with respect to one another out of one stable position into the other stable position, the flexible strips are located in a substantially radial plane of the two parts (FIG. 3*a*).

11 Claims, 18 Drawing Figures

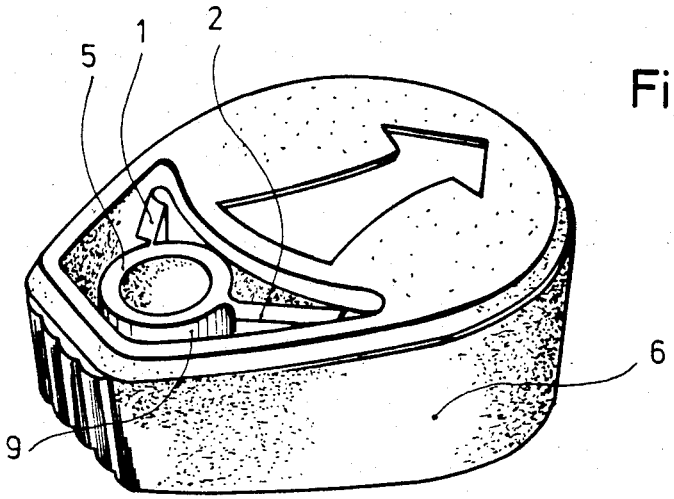
Fig. 2a
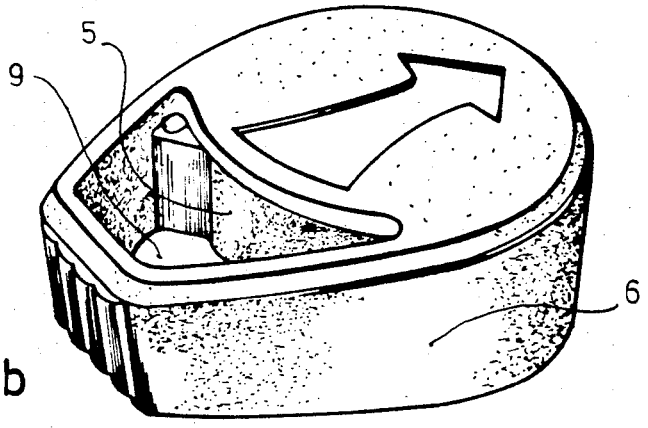
Fig. 2b
Fig. 2c
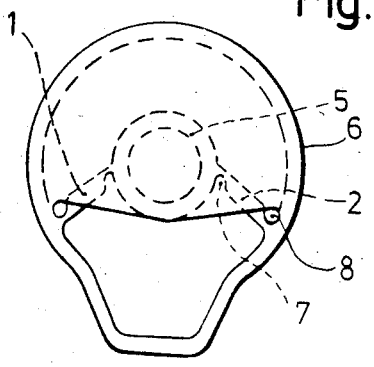
Fig. 2d
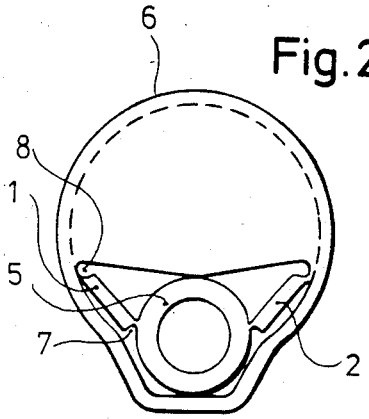

SNAP-ACTING SPRING DEVICE

BACKGROUND OF THE INVENTION

The invention relates to hinges and, more particularly, to a snap-acting spring device, hereafter called a bistable plastic hinge arrangement.

Hinges of the general class of the invention are known, for instance from German Patent No. 19 09 405, in combination with a clothes hanger, where the first and second parts form clamping faces between them, in order to be able to clamp an article of clothing firmly in the clothes hanger. A similar hinge is also known, for instance from German laid-open application No. DE-OS 24 59 628, in combination with a bottle closure, where the first part is the closure cap and the second part is a locking ring connected via the two flexible strips with the cap; in the closed state, the locking ring presses the cap against the bottle top at a location diametrically opposite the hinge.

SUMMARY OF THE INVENTION

The hinge arrangement of the invention can be used in the same manner for various applications and reliably maintains the stable position it has assumed at any time. It comprises an inner member, an outer member surrounding the inner member, and springlike connecting means between the members. The connecting means are so constructed as to establish an unstable, dead center position of one member relative to the other member, a first stable position on one side of the dead center position, and a second stable position on the other side of the dead center position.

Preferably, the inner part is substantially cylindrical, the outer part substantially surrounds the inner part, and as the connecting means at least two springlike strips are disposed at approximately diametrically opposed points on the circumference of the inner part or are connected to the outer part in such a manner that they extend between the inner and outer parts approximately in the manner of spokes of a wheel. If the articulation grooves of the strips are disposed substantially parallel to the cylindrical axis of the two parts, then the two parts are capable of executing a relative rotational movement with respect to one another, and in the dead center position of the two parts, the articulation grooves of each strip are located approximately in one radial plane of the two parts. The two stable rotational positions of the two parts are then located symmetrically with respect to the dead center position. However, if the articulation grooves of the strips lie in planes perpendicular to the cylindrical axis of the two parts, then in the dead center position of the two parts, all the articulation grooves are located in a common plane that extends substantially transversely relative to the cylindrical axis. In the case of cylindrical parts that are disposed vertically, the relative movement of these parts with respect to one another is accordingly a reciprocating movement, and the two stable positions of the two parts are again located symmetrically with respect to the dead center position.

In contrast, if the articulation grooves of the strips are disposed relative to the two parts such that in the two stable positions they each have both a directional component in planes perpendicular to the cylindrical axis and a directional component disposed parallel to the longitudinal cylindrical axis, then the two parts execute a relative movement with respect to one another which is made up of both a rotational movement and a longitudinal or reciprocating movement.

The hinge apparatus arrangement of the invention has many possible applications, for instance as a sliding closure for tubes of toothpaste or shampoo or the like, or as a container closure that executes a reciprocating movement in the vertical direction.

BRIEF DESCRIPTION OF THE DRAWINGS

The features of specific embodiments of the best mode contemplated of carrying out the invention are illustrated in the drawings, in which:

FIGS. 2*a*–2*d* are diagrams of one possible practical application for the embodiments shown in FIG. 1;

DETAILED DESCRIPTION OF THE SPECIFIC EMBODIMENT

Figure 1A:
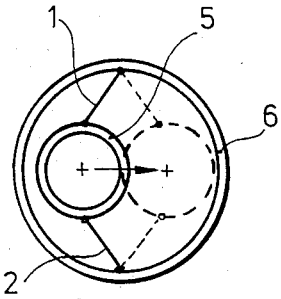
FIGS. 1*a*–1*e* are schematic diagrams of various embodiments of a first form of the invention.
Figure 1B:
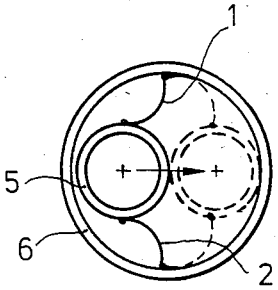
Figure 1C:
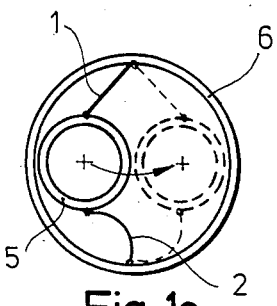
Figure 1D:
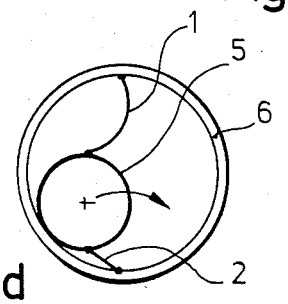
Figure 1E:
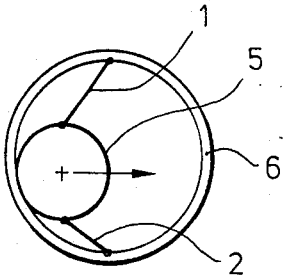

Various exemplary embodiments of a first form of the invention are shown schematically, either in cross section or from above, in FIGS. 1*a*–1*e*; in these embodiments, springlike strips 1 and 2 extend between a first cylindrical part 5 and a second cylindrical part 6. Articulation grooves (shown in detail in FIGS. 2*c* and 2*d*) each extend substantially parallel to the longitudinal cylinder axis of the two parts 5 and 6. Viewing strips 1 and 2 as structural beams, the articulation grooves represent in a plane perpendicular to the cylindrical axis regions of reduced cross section at which maximum bending, i.e., pivoting relative to parts 5 and 6, takes place. In all the embodiments, the first or inner part 5 is shown in solid lines when the two parts are in a first stable position, while this first part 5 is shown in dashed lines when the parts are in a second stable position. As is easily seen in the various figures, the two parts 5 and 6 each pass in the course of their relative movement from one stable position into the other stable position through an unstable dead center position, in which the articulation grooves of each strip 1 and 2 are located in a common radial plane of the two parts 5 and 6. This is true regardless of whether the flexible strips 1 and 2 are embodied as stiff, as shown in FIGS. 1*a* and 1*e*, or are both elastic, as shown in FIG. 1*b*. If both strips 1 and 2 are elastic in form, or if at least one of them is, as shown in FIGS. 1*c* and 1*d*, then the two parts 5 and 6 can be embodied as substantially inelastic, because in that case the required shortening of the distance between the articulation grooves of each flexible strip in the dead center position is effected or assumed by the strips themselves. It is the energy stored in the strips to effect such shortening that is then released to drive the parts 5 and 6 to the other stable position. On the other hand, if both flexible strips 1 and 2 are embodied as substantially inelastic, then at least one of the parts 5 or 6, preferably the outer part 6, must be made elastic so it can form an oblong shape, in order to take up or equalize the then unchanged distance between the articulation grooves during the passage of the articulation grooves through the dead center position. It is the energy stored in the elastic part to effect such oblong deformation that is released to drive the parts 5 and 6 to the other stable position. As may be seen from the individual figures, the two parts 5 and 6 execute either a purely longitudinal relative movement (FIGS. 1*a*, 1*b*, and 1*e*) or a relative movement composed of both a longitudinal and a rotational movement (FIGS. 1*c* and 1*d*). In a relative movement of this kind, it is unimportant whether the first part or the second part is considered to be the stationary or the movable one, or whether both parts execute not only a relative movement with respect to one another but also one that is relative with respect to some stationary point.

In a practical exemplary application shown in FIGS. 2*a*–2*d* for the form of the invention shown in FIG. 1, the first or inner part 5 forms the opening of a tube or the like, while the second or outer part 6 forms an approximately ellipsoid cap with a top surface 20 coplanar with the top surface of part 5. As shown in FIGS. 2*a* and 2*b*, the shape of the cap is arbitrary within wide limits, such as to form a gripping surface that is manipulatable, so long as the first part 5 has sufficient freedom of movement inside the second part 6 that it is capable of assuming the two possible stable positions.

The cap 6 is provided with an opening 9 shown in FIGS. 2*a* and 2*b*, so as to render the opening 5 of a tube accessible in the first stable position shown in FIG. 2*a* and, in the second stable position shown in FIG. 2*b*, to close the opening 5 of the tube in a sealing manner under the top surface 20.

In FIGS. 2*c* and 2*d*, the two stable positions of the two parts 5 and 6 are each shown, again in schematic form; in the dead center position of the two parts located between these two stable positions, the articulation grooves 7 and 8 of each flexible strip 1 and 2 are also located in a common substantially radial plane of the parts 5 and 6.

Figure 3A:
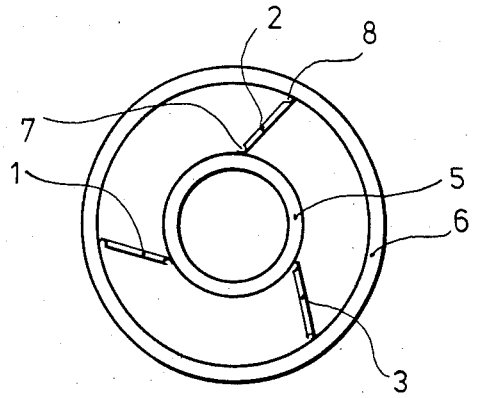
FIGS. 3*a* and 3*b* are schematic diagrams of further exemplary forms of the invention involving rotational motion.

In FIG. 3*a*, a further form of the invention is shown schematically, in which three springlike strips 1, 2, and 3 are located, in the one stable position of the parts 5 and 6 shown here, between these two parts in approximately the manner of spokes of a wheel. All the strips 1–3 are in turn connected to the first and second parts 5 and 6 via respective articulation grooves 7 and 8, in a manner not shown in detail here. In the stable position shown, each groove 8 is offset in a clockwise position relative to the corresponding groove 7. The articulation grooves 7 and 8 of all the strips extend substantially parallel to the longitudinal cylindrical axis of the parts 5 and 6.

In order to move the two parts 5 and 6 into the other stable position, they must be rotated relative to one another; the strips 1–3, and in particular their respective articulation grooves 7 and 8, then move through the unstable dead center position, in which the articulation grooves are each located in radial planes of the two parts 5 and 6, to the other stable position, in which each groove 8 is offset in a counterclockwise direction relative to the corresponding groove 7.

If the strips 1–3 are substantially stiff as shown here, that is, if they are embodied as inelastic, then at least one of the parts 5 and 6, preferably the second part 6, must be formed as elastic, in order to be able to move out of the way of the stiff strip 1–3 when in the dead center position.

Figure 3B:
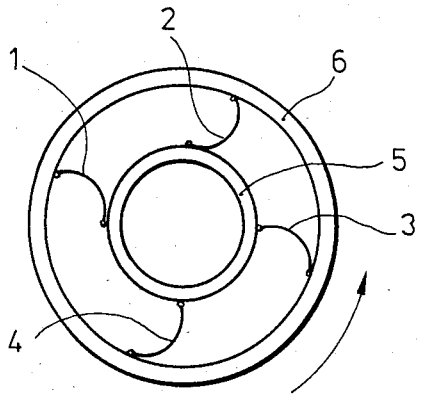

In FIG. 3*b*, a similar form of the invention is shown in schematic form; here, however, four springlike strips 1–4 are provided between the parts 5 and 6, the strips 1–4 being distributed uniformly over the circumferences of parts 5 and 6. In this embodiment, the strips 1–4 are embodied as elastic, that is, having an arched shape, so that it is possible for the two parts 5 and 6 to be embodied inelastically. In the unstable dead center position, the articulation grooves 7 and 8 of each strip 1–4 therefore move toward one another, so as to shorten the distance between them to the given radial distance between the two parts 5 and 6 at that time. A relative rotation also takes place between the parts 5 and 6 as they move through a dead center position into one of two stable rotational positions. These forms of the invention may also be used as closures for containers, in which opening slits, for instance those of containers with perforated lids intended for sprinkling, are alternatively uncovered and covered in the different stable positions of the two parts 5 and 6. In other words, parts 5 and 6 each have adjacent surfaces with slits—in one stable position the slits are aligned and in the other stable position, the slits are misaligned.

Figure 4A:
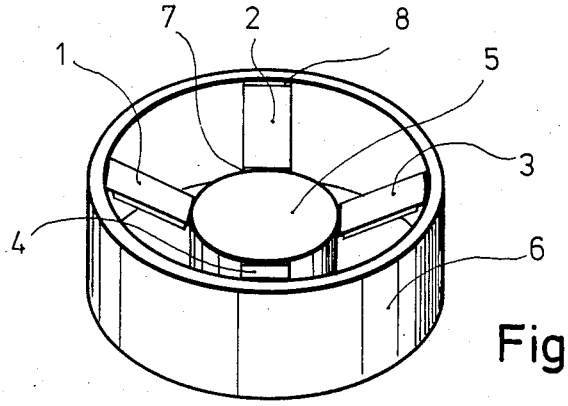
FIGS. 4*a*–4*d* are diagrams of still other exemplary forms of the invention involving reciprocating motion.
Figure 4B:
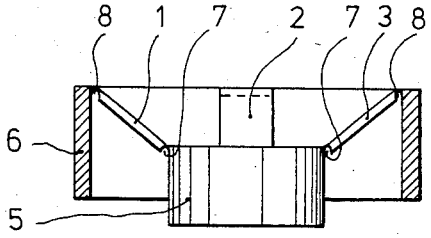
Figure 4C:
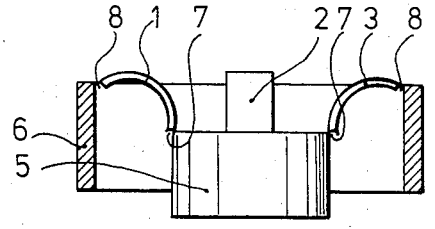

In FIGS. 4*a*–4*c*, a further exemplary embodiment is shown, in which four strips 1–4, by way of example, are disposed between the first and second parts 5 and 6. Strips 1–4 are uniformly distributed around the circumferences of parts 5 and 6. In this case, however, the articulation grooves 7 and 8 lie in planes perpendicular to the cylindrical axis of the two parts 5 and 6, so that in the course of the relative movement of the parts 5 and 6 out of one of their stable positions into the other, it is not a movement in a plane perpendicular to the cylindrical axis but rather a longitudinal axial movement that is executed. In one stable position, grooves 7 lie in a plane below grooves 8 and in the other stable position grooves 7 lie in a plane above grooves 8. Again a passage through an unstable dead center position of the parts 5 and 6 takes place, in the course of which the two articulation grooves 7 and 8 of each springlike strip 1–4 are each located in a plane extending substantially transversely to the longitudinal cylindrical axis.

As is shown particularly in FIGS. 4*b* and 4*c*, the springlike strips 1–4 here may again be either rigid, that is, inelastic, or arched, that is, elastic in form. In the first instance, the two parts 5 and 6 must then be elastic in form in a complementary manner, while in the second case they may be inelastic.

Figure 4D:
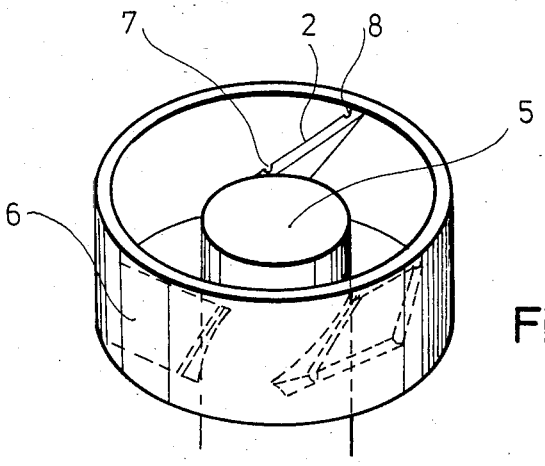

A similar, but modified, exemplary embodiment is shown in schematic form in FIG. 4*d*; here, the springlike strips between the parts 5 and 6 are articulated on these two parts via articulation grooves 7 and 8 in such a manner that the articulation grooves 7 and 8 have both a directional component in planes perpendicular to the cylindrical axis and a directional component disposed substantially parallel to the cylindrical axis. In the stable positions of the two parts 5 and 6, the individual strips are therefore displaced both in a rotational direction as shown for instance in FIG. 3*a* and in a cylindrical axial direction as shown for instance in FIG. 4*a*.

In the course of the relative movement of the two parts 5 and 6 out of one of their stable positions into the other, both a relative rotation and a relative axial displacement take place, and in the dead center position of the parts 5 and 6 the two articulation grooves 7 and 8 of each flexible strip 1–4 again must be located both in a radial plane of the cylinders and a plane perpendicular thereto.

These exemplary embodiments again may be used as closures for containers, for instance such that in one stable position they open perforations intended for sprinkling or the like, provided on the jacket face of the second part 6 and/or on the end face of the first part 5, while in the other stable position they close them.

Figure 5A:
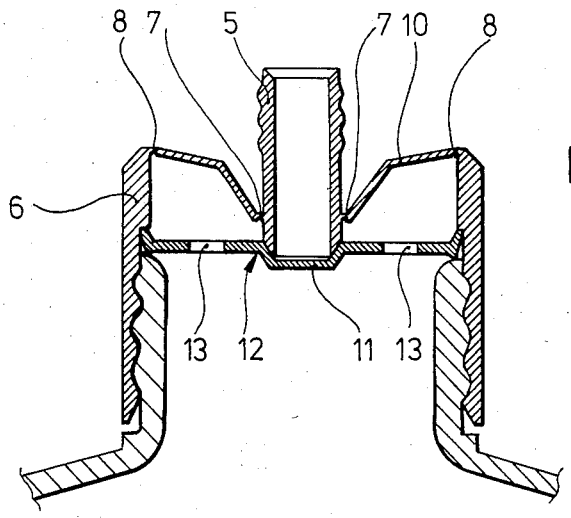
FIGS. 5*a*–5*c* are diagrams of a further possible practical application of exemplary forms of the invention.
Figure 5B:
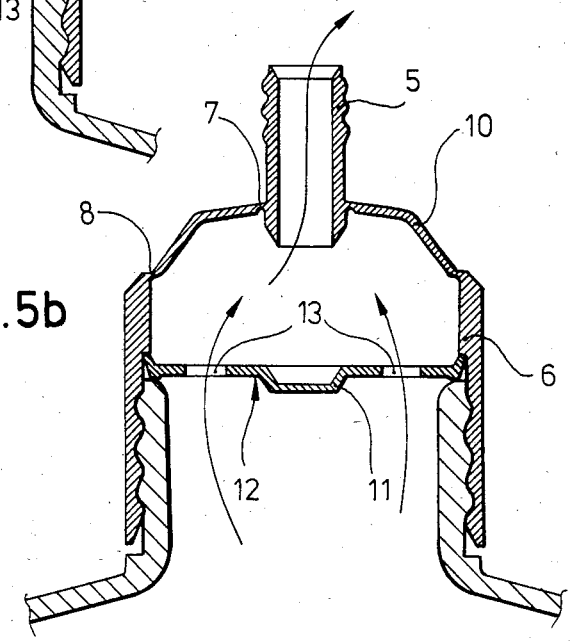
Figure 5C:
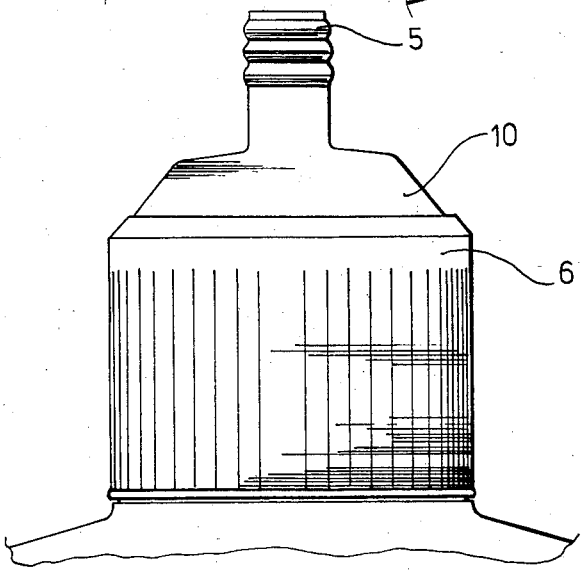

In FIGS. 5*a*–5*c*, a further exemplary embodiment is shown, as well is an associated possible application, both in schematic form. In this exemplary embodiment, the individual springlike strips are transformed into an unperforated springlike diaphragm 10; the articulation grooves 7 and 8 are formed as circles on the inner and outer circular circumferences, respectively, of the diaphragm 10, which is a circular ring. The grooves 7 and 8 thereby connect the diaphragm 10 with both the inner, first part 5 and the outer, second part 6.

As is clearly shown in the drawing, in an application of this kind, the first part 5 may be embodied as a pouring spout and the second part 6 as a container top, which is, by way of example, screwed, onto the neck of a bottle. A sealing disc 12 is disposed below the diaphragm 10 and has a plurality of openings 13, through which a fluid contained in the bottle can flow into the space between the diaphragm 10 and the sealing disc 12. The sealing disc 12 is provided with a sealing recess 11 shown here merely in schematic form, on which the pouring spout 5 is seated in a sealing engagement when in the first stable position shown in FIG. 5*a*, so that fluid flowing through the openings 13 into the space between the diaphragm 10 and the sealing disc 12 cannot be poured out through the pouring spout.

In the opened position of the closure shown in FIG. 5*b*, in contrast to the above, the pouring spout 5 is raised from the sealing recess 11 in the second stable position of the parts 5 and 6, and the fluid flowing through the openings 13 of the sealing disc 12 can pour out through the pouring spout 5.

In FIG. 5*c*, this exemplary embodiment is shown schematically as seen from the outside in the open position.

Although it is not shown in the drawing, the exemplary embodiment shown in FIGS. 5*a*–5*c* can also be modified in such a manner that the inner part 5 is embodied not as a pouring spout but rather as a closure cap, which in the stable position of the two parts 5 and 6 shown in FIG. 5*a* closes the only opening of the sealing disc 12 which is provided in the vicinity of the sealing recess 11. In that case, the sealing disc 12 naturally does not have any openings 13. The diaphragm 10 or some jacket portion of the second part 6 must then be provided with openings as well, so that in the opened position shown in FIG. 5*b* the fluid that has entered the space between the sealing disc 12 and the diaphragm 10 can be poured out.

In each of the described forms of the invention, parts 5 and 6 and the springlike strips or diaphragm, as the case may be, are preferably incorporated in a one piece plastic, molded construction; the parts 5 and 6 and springlike strips are made elastic or inelastic by designing them to be thick or thin, respectively, in cross section.

German application No. P3147903.0, filed Dec. 3, 1981, and laid open on June 16, 1983 as DE-OS 31 47 903, is incorporated fully herein by reference.

What is claimed is:

1. A bistable hinge arrangement in a one-piece plastic construction comprising:

a substantially cylindrical inner member having a cylindrical axis parallel to a longitudinal axis;

a substantially cylindrical outer member surrounding the inner member and having a cylindrical axis parallel to the longitudinal axis; and springlike connecting means between the members so constructed as to establish an unstable dead center position of one member relative to the other member, a first stable position on one side of the dead center position, and a second stable position on the other side of the dead center position, the connecting means comprising a plurality of springlike strips between the inner member and the outer member, each strip having an articulation groove where such strip joins the inner member and an articulation groove where such strip joins the outer member, the articulation grooves being parallel to the longitudinal axis and being adapted so maximum bending of the strips takes place at the articulation grooves.

2. The hinge of claim 1, in which the inner and outer members are concentric and there are at least three strips so adapted that the members rotate with respect to each other when moving between the first and second positions.

3. The hinge of claim 2, in which the strips are substantially inelastic and one of the members is elastic.

4. The hinge of claim 2, in which the members are substantially inelastic and the strips are substantially elastic.

5. The hinge of claim 1, in which there are two diametrically opposed strips so adapted that the stable positions are located on opposite sides of the longitudinal axis.

6. The hinge of claim 5 in which one of the members is substantially elastic and the strips are substantially inelastic.

7. The hinge of claim 5, in which the members are substantially inelastic and the strips are substantially elastic.

8. The hinge of claim 5, in which one of the strips is substantially elastic and the other strip is substantially inelastic.

9. The hinge of claim 5, in which the strips are substantially equal in length.

10. The hinge of claim 5, in which the strips are different in length.

11. The hinge of claim 5, in which the inner member has top surface and forms a container opening and the outer member forms a cap having an open region and a top surface coplanar with the top surface of the inner member, the inner member being in the open region of the outer member in one stable position to open the container and being under the top surface of the outer member in the other stable position to close the container.

* * * * *